US006167825B1

(12) United States Patent
Marchetti

(10) Patent No.: US 6,167,825 B1
(45) Date of Patent: Jan. 2, 2001

(54) EQUIPMENT FOR SEWING MACHINES FOR OBTAINING A FLAT SEAM WHEN JOINING PIECES OF SHEER KNIT FABRIC

(75) Inventor: Luigi Marchetti, Castiglione delle Stiviere (IT)

(73) Assignee: Golden Lady S.p.A. (IT)

( * ) Notice: Under 35 U.S.C. 154(b), the term of this patent shall be extended for 0 days.

(21) Appl. No.: 09/214,462

(22) PCT Filed: Apr. 9, 1997

(86) PCT No.: PCT/IT97/00076

§ 371 Date: Dec. 28, 1999

§ 102(e) Date: Dec. 28, 1999

(87) PCT Pub. No.: WO98/00594

PCT Pub. Date: Jan. 8, 1998

(30) Foreign Application Priority Data

Jun. 28, 1996 (IT) ..... FI96A0158
Nov. 27, 1996 (IT) ..... FI96U0142

(51) Int. Cl.[7] ..... D05B 1/20; D05B 61/00
(52) U.S. Cl. ..... 112/162; 112/188; 112/260

(58) Field of Search ..... 112/162, 177, 112/163, 166, 198, 475.26, 260, 197, 288, 200, 187, 199

(56) References Cited

U.S. PATENT DOCUMENTS

| | | | |
|---|---|---|---|
| 3,079,882 | 3/1963 | Washburn et al. | 112/163 |
| 3,885,509 | 5/1975 | Cox | 112/441 |
| 4,303,030 | 12/1981 | Palacino et al. | 112/288 X |
| 4,791,874 | 12/1988 | Shiomi | 112/260 X |
| 4,984,526 | 1/1991 | Ide et al. | 112/288 X |
| 5,503,094 | 4/1996 | Tseng | 112/260 |

*Primary Examiner*—Ismael Izaguirre
(74) *Attorney, Agent, or Firm*—McGlew & Tuttle, P.C.

(57) ABSTRACT

The equipment comprises in combination: a twin needle (15, 17) fed with two needle threads (F1, F2); an upper looper (30) fed with a looper thread (F3), and a lower spreader (31); a throat plate (36) with two slots (38, 40) for the needles (15, 17) and the stitch finger (42) on the line of the cut (T) of increased width (D); and a thread-pulling arm (25) for pulling off an increased amount of the thread (F3) for the looper at each angular stroke.

4 Claims, 7 Drawing Sheets

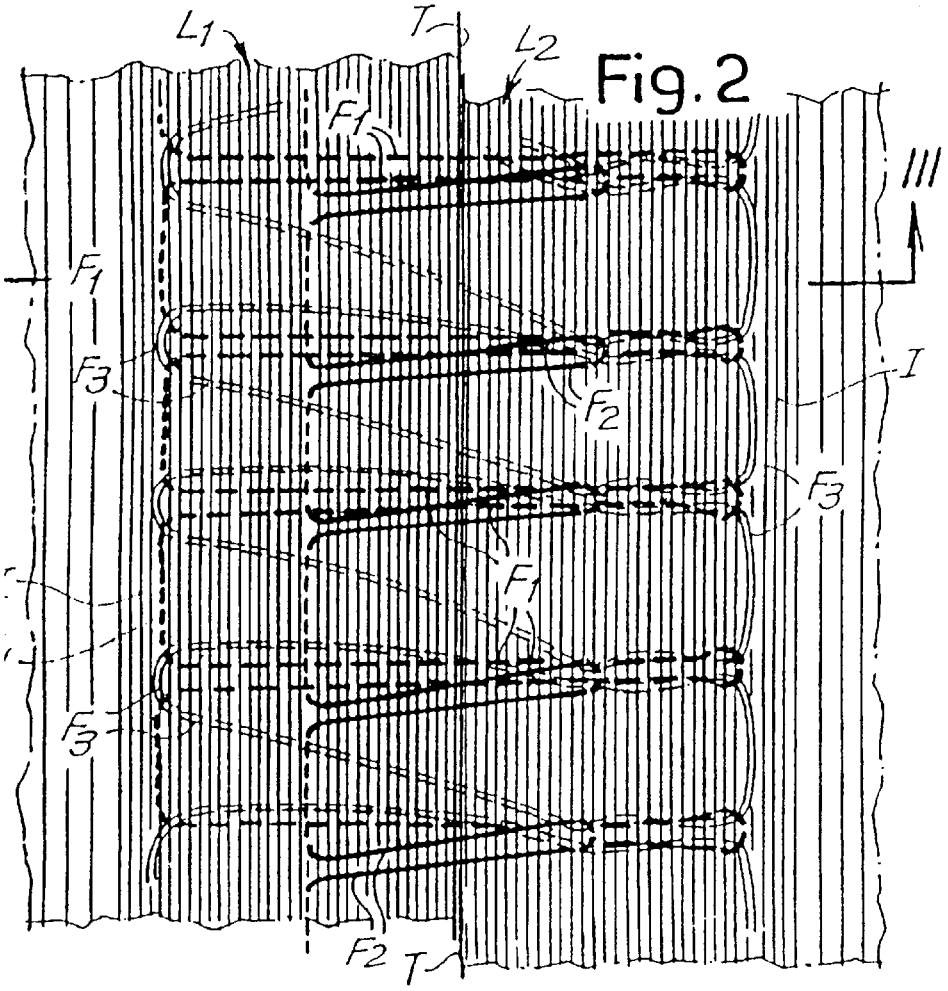
Fig. 2
Fig. 3
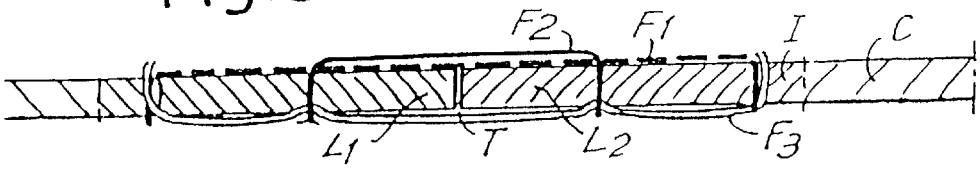

Fig. 6
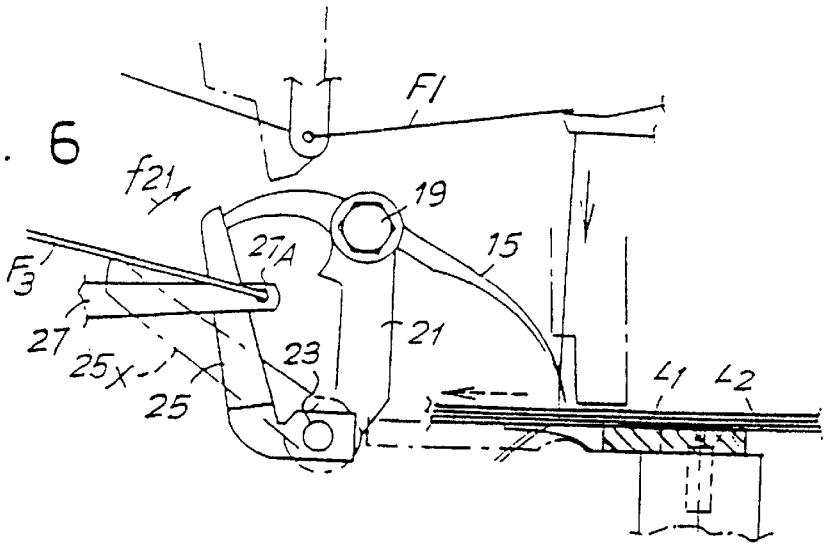
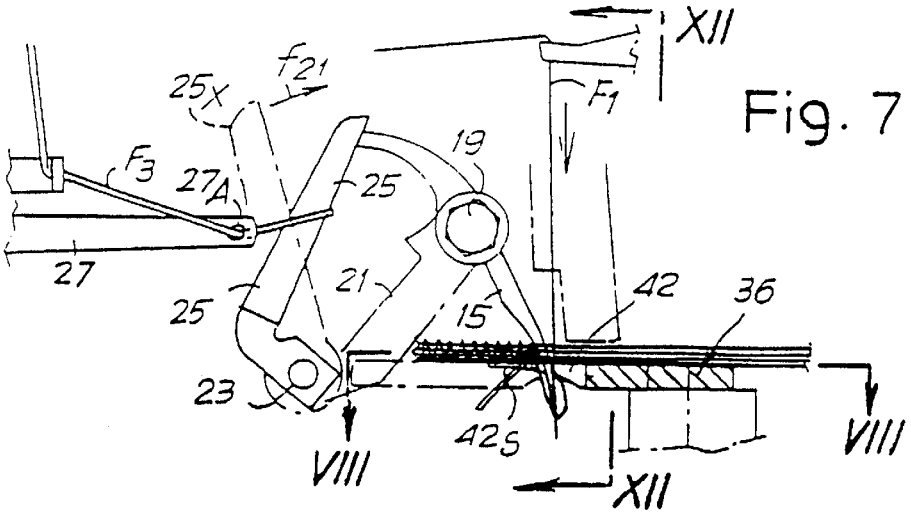
Fig. 7

EQUIPMENT FOR SEWING MACHINES FOR OBTAINING A FLAT SEAM WHEN JOINING PIECES OF SHEER KNIT FABRIC

FIELD OF THE INVENTION

The present innovation relates to equipment intended to be fitted to "overlock" machines, such as the well-known machines made by Union Special, Juki, Rimoldi and others, to make them suitable for producing a seam of little thickness, when sewing articles made of sheer knit fabric, such as women's stockings, panty-hose (tights) and the like.

BACKGROUND OF THE INVENTION

The overlock machine is also used as a component of assemblies or lines of machinery—such as, for example those produced by "Takatori" of Japan, "Detexomat" of Great Britain, and "Solis" of Italy which require the manual intervention of an operator only to feed in the pair of pieces of fabric to be assembled and automatically assemble the parts of the knitted fabric that go to make up the panty-hose and/or sew the stocking toes. In these complexes or lines of machinery the overlock machine "automatically" (i.e. also without requiring to be guided and controlled by a person) cuts the pieces of fabric and joins them together by seams with oscillating needles and "loopers".

The only problem is that the seams that can be produced on these machines, in which the margins of the pieces of fabric being joined are drawn tightly together (the "overlock" seam) have considerable thickness, assuming the form of a cord; this is undesirable both as regards the comfort and "wearability" of the garment, owing to the irritation produced by a seam of this shape, and as regards the aesthetic acceptability of the garment, it being desirable for both of the above reasons, practical and aesthetic, to have a "flat" seam, that is to say a seam that is slightly wider and very much less thick.

To produce such a flat seam (a "flatlock" seam), machines of another and quite different type can be used: these are not, however, "overlock" machines, being unsuitable for cutting the fabrics but only for sewing them, and moreover being unable to operate "automatically", having instead to be controlled and guided manually by a special operator who must be skilful and expert at the task; such machines cannot therefore be introduced into the abovementioned lines of machinery designed for the automatic assembly of tights.

Union Special overlook machines, as well as JUKI, Rimoldi and other types, have been successfully used to produce this "flatlock" seam only in the production of foundation garments, in which the fabrics used are very much thicker and have a denser weft than those used in the production of women's stockings and tights. This is because in the production of foundation garments, in view of the greater strength of the fabric employed, the fabric pieces can be joined together with seams of loose stitches, made up, that is to say, of slack stitches without tension, in which seam the margins of the pieces of fabric to be sewn together are not drawn tightly together and therefore do not give the seam the cord-like appearance, but nonetheless overlap a certain width.

SUMMARY AND OBJECTS OF THE INVENTION

With the equipment described herein, however, it is possible to make the abovementioned type of overlook machine capable of producing a special form of flat seam for joining together sheer knit fabrics such as those of women's stockings and panty-hose. This particular form of seam is different from that obtained with that type of sewing machine which is not suitable for operating "automatically" and which therefore requires to be controlled and guided by hand by a highly skilled person; but it too is similarly very thin. The result with this equipment is that the margins of the fabric pieces to be assembled have practically no overlap and instead are "edge-to-edge", i.e. "adjacent" and "juxtaposed", or overlie or overlap each other only very partially at least when the garment is put on and therefore stretched; and this without in any way detracting from the strength of the seam and of the article.

The present equipment has been designed for sewing machines known as overlooks comprising a throat plate with needle slots and with a stitch finger on the line of the cut, an upper looper, a lower looper, cutting means and means for feeding the two pieces of fabric to be sewn, feeders for feeding needle threads and looper thread, and a looper thread pull-off member, with the object of producing seams with loose stitches, i.e. flatlock seams on sheer knit fabrics for panty-hose or tights. The equipment characteristically comprises in combination:

A—a twin needle fed with two needle threads;

B—an upper looper and a lower looper, one of which is fed with a looper thread with chain stitches, the other being a spreader;

C—a throat plate that has two slots for the needles and a stitch finger (on the line of the cut) of increased width, for forming relatively long seam stitches; and D—a looper thread pull-off member, modified in order to increase the amount of looper thread pulled off by it each time.

In practice the looper thread, for forming the chain stitches, is fed to the upper looper.

More particularly the aforesaid stitch finger of said throat plate comprises, in the area where the loops are formed, a portion with approximately parallel sides before the final narrowing. Said stitch finger is advantageously also elongate in the longitudinal direction, that is, in the direction in which the fabrics to be sewn are fed. In addition, said stitch finger of the throat plate is reduced, i.e. made thinner, on the underside, to make way for the movements of the lower looper.

The lower spreader is reduced, i.e. made thinner, so as not to interfere with the throat plate and with the stitch finger of the latter. Similarly the upper looper is advantageously reduced, i.e. made thinner, so as to help the threads to run better and to avoid interferences.

The looper thread pull-off member, which is a thread-pulling arm oscillating with the moving assembly of the bar of the needles, is positioned on the needle bar at an advanced angle in order to increase the active stroke of said pull-off member and thereby increase the amount of looper thread pulled off at each downward stroke of the needles.

With the above equipment the result is basically a seam consisting of three threads forming three series of stitches, specifically:

a) a first series of short stitches, formed with a first needle thread, which extend across the "line of the cut", passing out of one of the two pieces of fabric being joined together and entering the other at positions relatively near to the cut edges;

b) a second series of longer stitches, formed with a second needle thread, which stitches also extend across the line of the cut, passing out of one of the two pieces of fabric being assembled and entering the other at a greater distance from the same line of the cut than the stitches forming the aforesaid first series of stitches, so that the shorter stitches of the first series of stitches lie inside the longer stitches of the second series of stitches; and c) a third series of stitches, formed with "slack" stitches of a looper thread, much longer and "slacker" than those of the first two series of stitches, which stitches of the third series form the "chain" seam, extending across the line of the cut and forming chain stitches with the first and second needle threads.

It follows from the structural characteristics of the seam described above that, under the stretching of the garment as it is put on, the seam becomes wider and quite flat, with virtually no overlapping of the fabric pieces. This has the obvious advantages of greater comfort and a much more pleasing appearance of the garment. There is no disadvantageous impact on either the practical or aesthetic effect from the fact that the width of the flat seam produced in this way cannot be made to equal that obtained with the type of seam produced with only manual sewing machines; because in fact, from the aesthetic point of view, it is actually decidedly preferable, in tights and stockings, for the width of the seam to be limited.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIGS. 2, 3 and 4 show an enlarged detail of the area indicated by arrow fII, a cross section on III—III from FIG. 2 and an enlarged view of a detail indicated by arrow fIV in FIG. 1;

FIGS. 6 and 7 are a diagrammatic lateral view of a detail from FIG. 5 to illustrate the two extreme positions of the needles and the increased feeding of the thread to the upper looper;

DESCRIPTION OF THE PREFERRED EMBODIMENT

Figure 1:
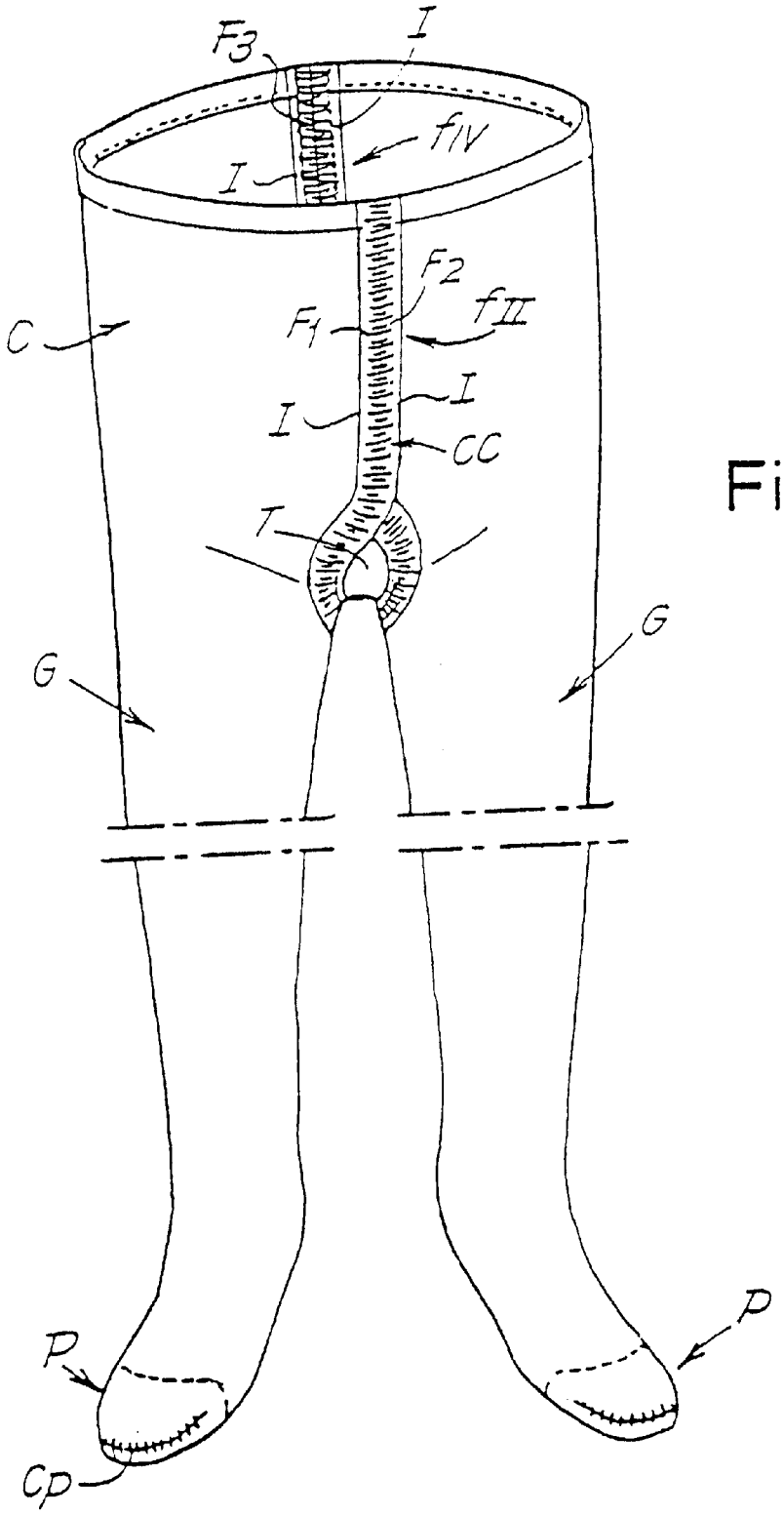
FIG. 1 shows a highly diagrammatic perspective view of a pair of panty-hose or tights.

The accompanying drawing, with initial reference to FIGS. 1 to 4, shows the so-called "flatlock" seams of loose, flat stitches, which are used to close the toes P and to connect the two components, each of which consists of a leg G and a portion of the body section C, along the crotch, with the possible addition of a gusset T. The toe seam is marked CP, while the seam along the crotch line is given the general reference CC and is shown in greater detail in FIGS. 2 to 4. In the seam area the fabric of the two pieces L1 and L2, which are sewn together, can optionally be formed by two portions of non-run fabric marked I, while further away, the fabric of the article can be made with a normal knit and is therefore more elastic and more suited to the function of the article, using techniques known per se; the non-run portions I along the pieces L1 and L2 that are to be sewn give the knitted stitches greater resistance to unravelling because of the cut made by the overlock machine along the lines T.

The seam is made with two needle threads F1 and F2 and one looper thread F3. Thread F1 makes long stitches, while thread F2 makes short stitches positioned in an intermediate position relative to that occupied by the long stitches formed by thread F1; the third thread F3 is fed to a looper and forms the chain stitches, which are particularly visible on the opposite side to that on which the long stitches of thread F1 and short stitches of thread F2 can be seen. The long stitches and short stitches of threads F1 and F2 respectively are particularly visible in FIG. 2, while the looper stitches, the so-called chain stitches, formed by thread F3 are visible more in FIG. 4. Thread F1 for forming the long stitches is fed to the needle that passes through the pieces L1 and L2 at the furthest position from the line of the cut T, while thread F2 is fed to the needle closest to the line of the cut T.

The so-called flatlock seam described above is particularly effective because under the conditions of tension of the fabric when the article is worn, the two pieces L1 and L2—which are connected by the seams such as CP and such as CC formed by threads F1, F2 and F3—are basically brought edge-to-edge along the lines of the cut T with no overlap and especially without that cord-like bunching up of the fabrics which is present in the conventional structure of seams produced by overlock machines. The seam can be produced in such a way that the stitches formed by threads F1 and F2 lie primarily on the outside while the stitches formed by thread F3 of the chain-stitch seam produced with the thread fed to the looper are on the inside of the article when worn. However, the possibility of choosing the reverse position of that indicated is not excluded.

Essential considerations in the seam that is to be produced are what strength is desired and how much stretch capacity is required of the two pieces L1, L2 sewn together, which stretch is produced by increasing the length of the long stitches and short stitches (with threads F1 and F2) and likewise the chain-stitch seam (with thread F3).

Figure 5:
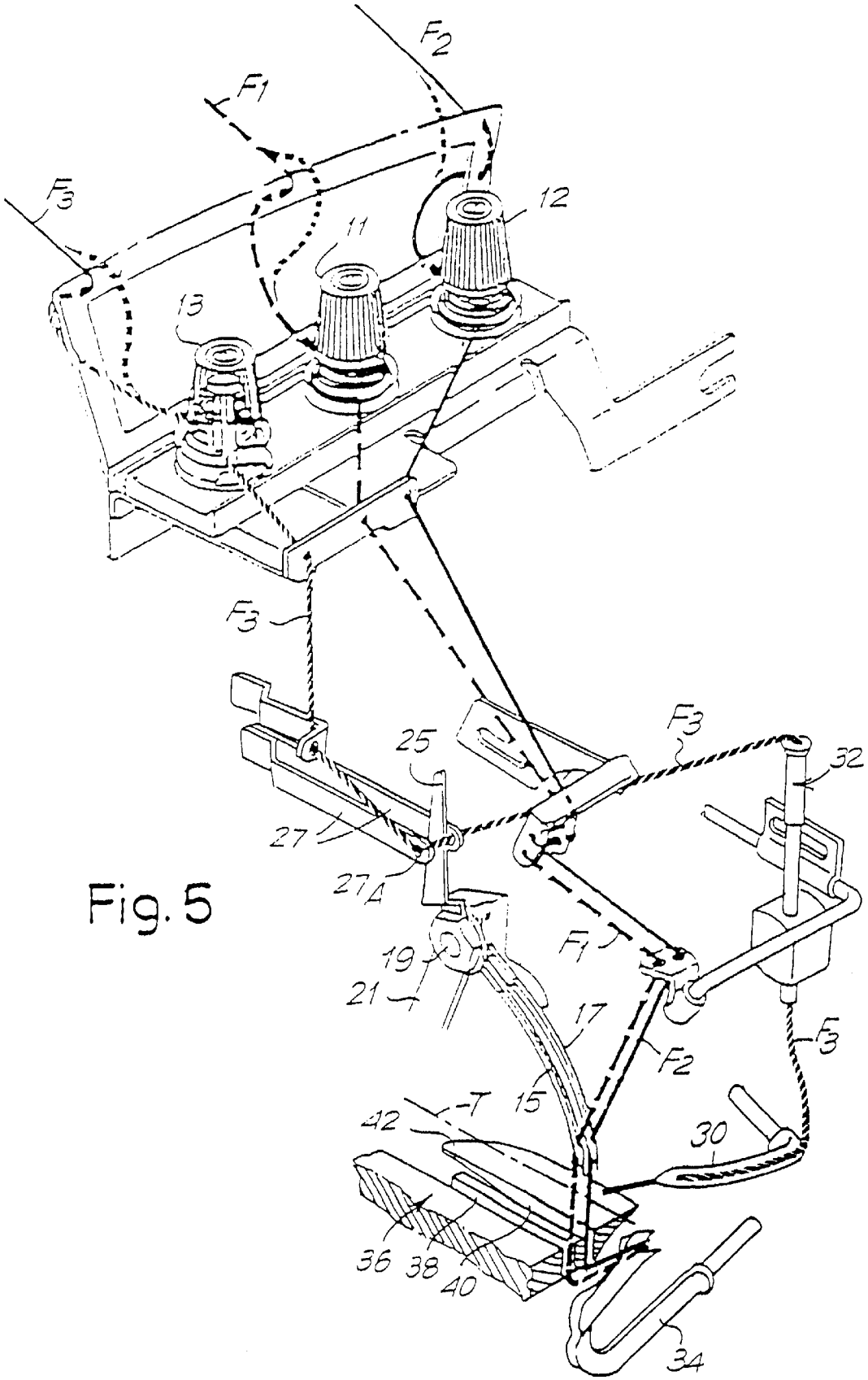
FIG. 5 shows a perspective diagram of the feeding of the threads in an overlock machine of the type indicated above.
Figure 10:
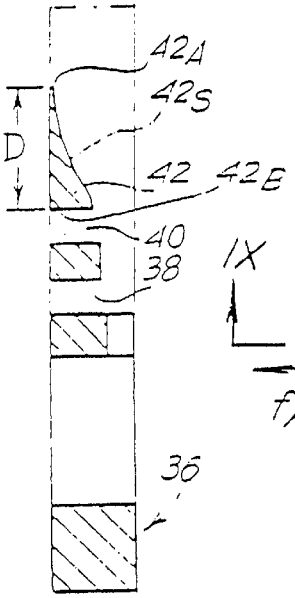
FIGS. 9, 10 and 11 show a view on IX—IX, an enlarged section of X—X as marked in FIG. 8 and a perspective view of the underside of said throat plate.
Figure 9:
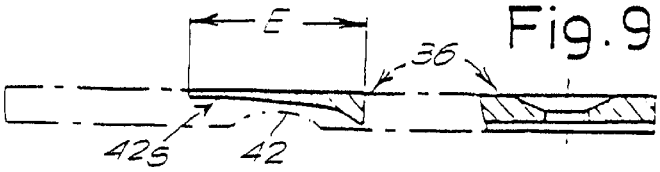
Figure 8:
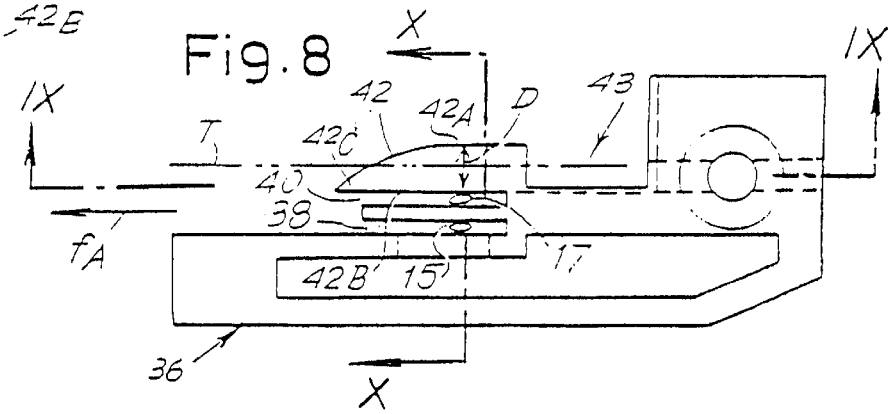
FIG. 8 shows a view on the plane VIII—VIII as marked in FIG. 7 which illustrates the throat plate modified to produce the seam shown in FIGS. 2 to 4.
Figure 11:
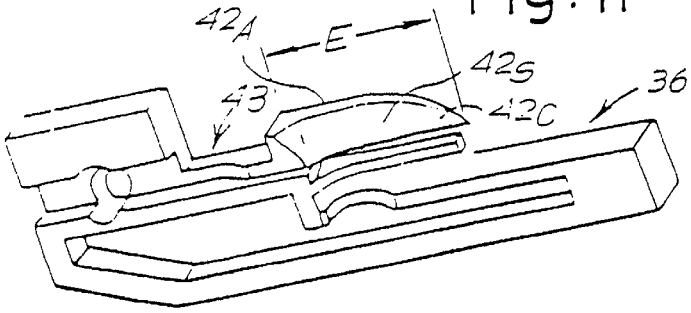

FIGS. 5 ff show the equipment with which a sewing machine of the overlock type as indicated above is fitted to produce the seam defined above. Of the complicated overlock machine of the conventional type, well-known to the experts, only certain significant parts are shown, notably those that form part of said modified equipment for adapting the machine to produce the seam defined above. Typical parts of the overlock machine are referred to in the course of the following description, with its modifications and variants explained.

The three threads F1, F2 and F3 are fed, as shown in FIG. 5, through respective tension discs 11, 12 and 13 and suitable thread guides. Thread F1 is fed to needle 15 which is furthest from the cut edge, i.e. the line of the cut T shown in the drawing as a chain line, particularly in FIGS. 5, 8, 10, 11 and 12. 17 indicates the needle closest to the line of the cut and fed with thread F2. Both the needles 15 and 17 are fixed at 19 to the needle bar 21, which oscillates about a shaft 23. Said shaft controls a moving assembly that must be made to oscillate and that comprises the needle bar 20, the needles 15 and 17 and a thread-pulling arm 25 whose function is to pull off thread F3 for the chain stitch formed with the help of an upper looper 30 described below. This thread-pulling arm 25 replaces the conventional thread-pulling arm which is outlined at 25X, and, like the latter, is positioned between two adjacent arms 27, each of which has a guide hole 27A at its end for the thread F3 to be fed to the upper looper. The shape of the thread-pulling arm is modified and the position of this thread-pulling arm 25 is further forward—compared with the position of the conventional thread-pulling arm 25X—in the direction of arrow F21, which indicates the movement of the moving assembly of the needle arm 21 and of the thread-pulling arm 25 in the direction in which the needles 15 and 17 move down when passing through the pieces L1, L2 of fabric to be sewn. The result is that (see in particular FIG. 7) the amount of thread F3 pulled off by the thread-pulling arm 25 for forming the chain-stitch seam is longer than the amount of thread that could have been pulled off by a thread-pulling arm 25X of the conventional type, which stops before the arm 25 (as shown in FIG. 7) with respect to the holes 27A of the arms 27.

The numeral 30 denotes an upper looper to which thread F3 is fed; thread F3 is guided by thread guide means 32 after having been guided by the holes 27A. The numeral 34 denotes a lower spreader having a forked end for collecting threads F1 and F2 when these have been brought by needles 15 and 17 down below fabric pieces L1 and L2 by the oscillation of the moving assembly 21, 17, 15, 25 in the direction of arrow f21 shown in FIGS. 6 and 7.

The numeral 36 is a general indication for a throat plate or needle plate whose general shape is analogous to that of known plates of this kind for the formation of seams in the abovementioned conventional machines, but its shape has been modified as indicated here: the throat plate 36 comprises two longitudinal slots 38 and 40 for the two needles 15 and 17, respectively, and comprises, next to slot 40, a stitch finger 42 situated generally on the position of the line of the cut T. It is on this line that knives act in a space 43 provided for this purpose in the throat plate 36. The stitch finger 42 comprises an initial portion with straight sides 42A, 42B and with an approximately constant width D that is greater than the corresponding dimension of the stitch finger present in the conventional type of throat plate; this constant dimension D extends through the area where the needles 15 and 17 and the upper looper 30 and lower looper 34 operate. In dimension E, the stitch finger 42 is also increased in the longitudinal direction, that is, the feed direction fA indicated in FIG. 8, which is the direction in which the pair of fabric pieces L1 and L2 are fed, cut along the line of the cut T and sewn; the stitch finger 42 then tapers to an almost sharp end 42C. Characteristically, the stitch finger 42 is also reduced on the underside to allow room for the lower spreader 34, the movement of which is similar to that of the conventional spreaders; 42S denotes the reduced or thinner underside of said stitch finger 42. As an order of magnitude, the constant dimension D may be around 3 to 5 mm and more particularly around 4 mm for sheer panty-hose articles. The width of each of the longitudinal slots 40 and 38 is also of the order of a millimeter. These dimensions are used to determine the distance between the edge 42A of the stitch finger 42 and the position of the needles 15 and 17 when lowered by the oscillating moving assembly of the arm 21 through the two fabric pieces L1 and L2 and the slots 40 and 38, for the formation of the various stitches as indicated and clearly visible in FIGS. 2, 3 and 4.

Figure 4:
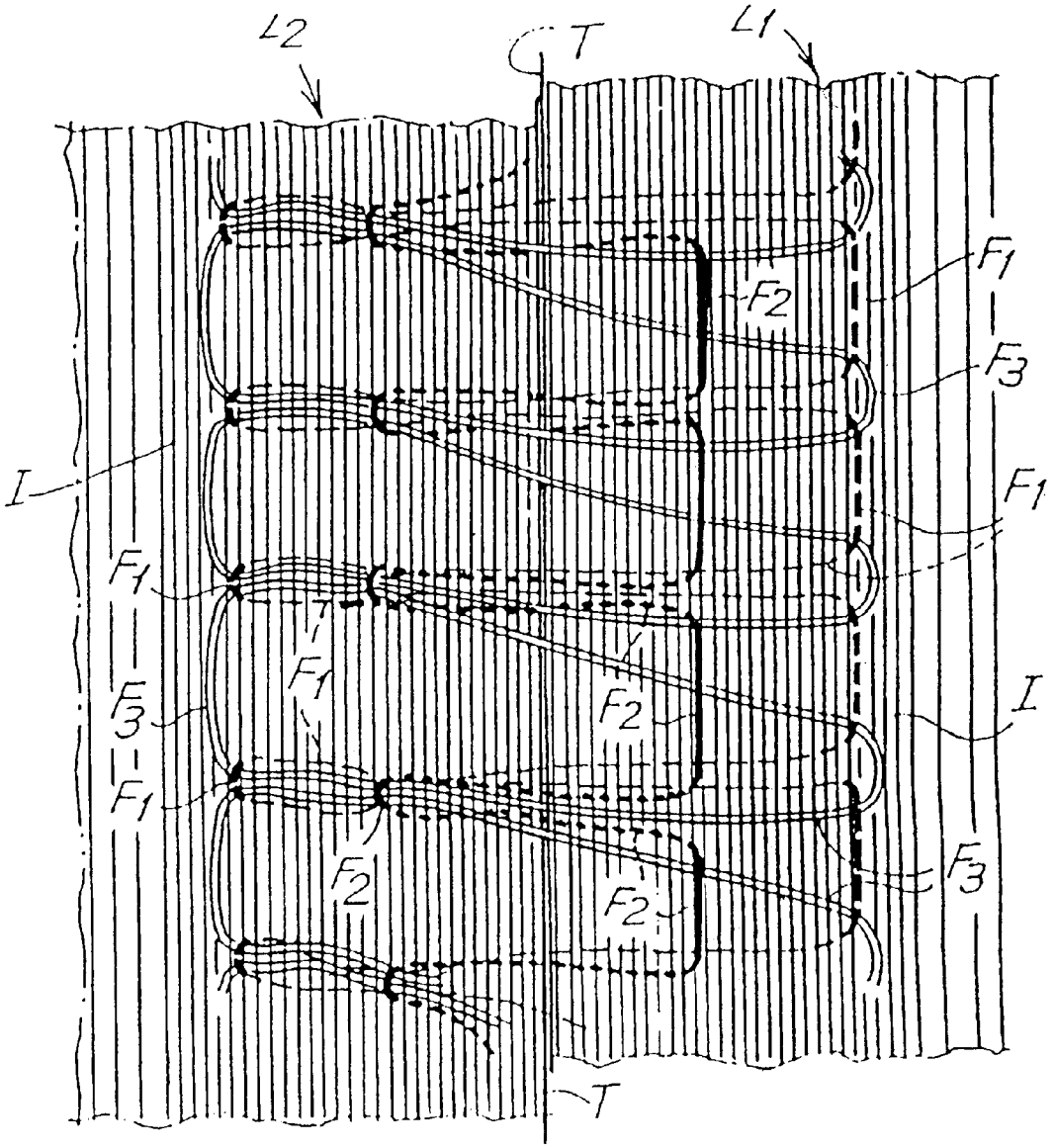
Figure 14:
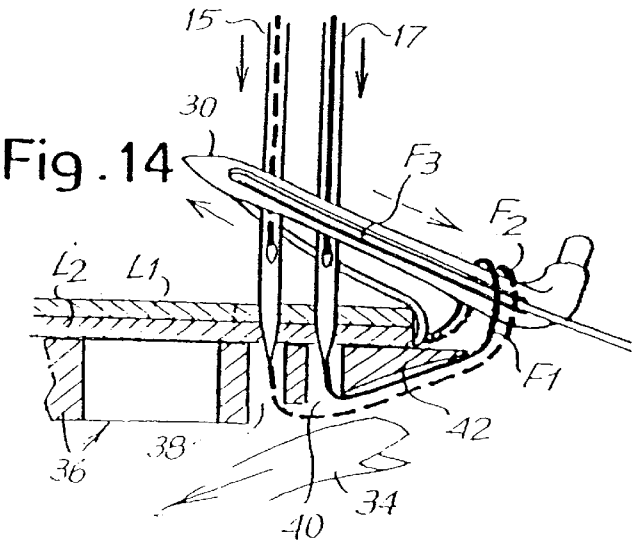
FIGS. 12, 13, 14 and 15 show diagrammatic views roughly on the plane marked XII—XII in FIG. 7 with various positions assumed by the members illustrated here during one cycle.
Figure 15:
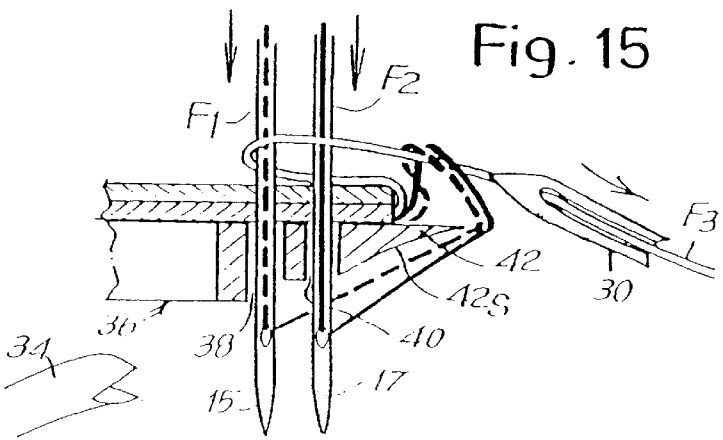
Figure 12:
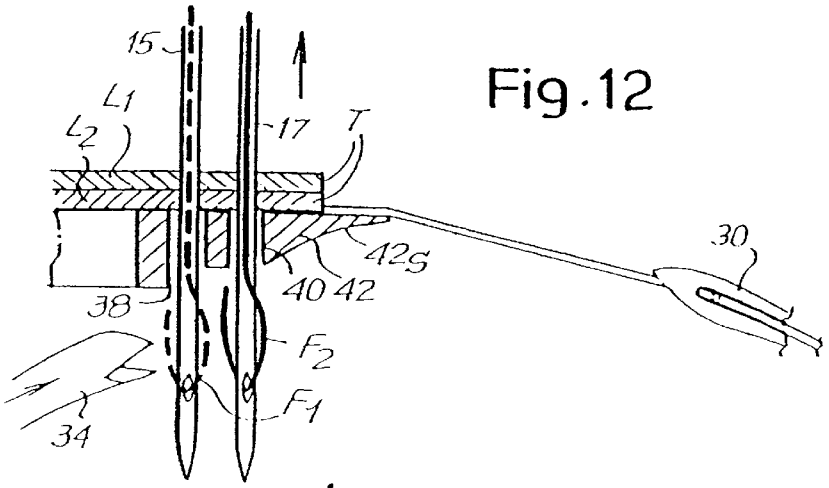
Figure 13:
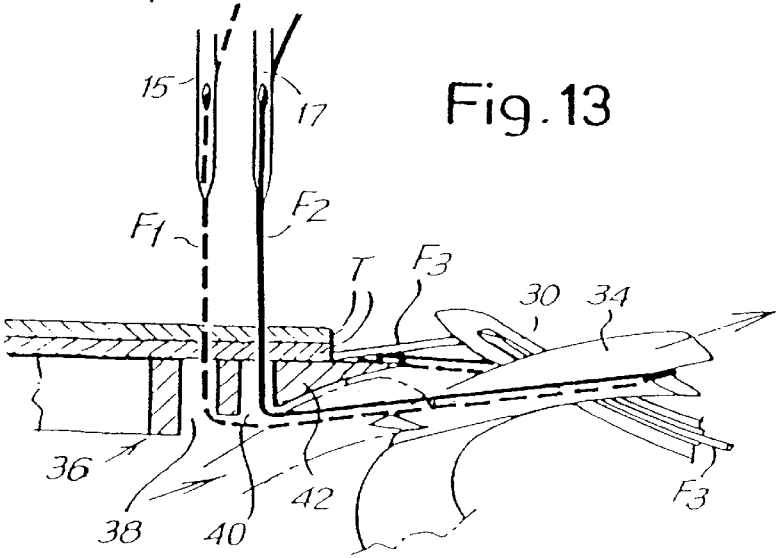

FIGS. 12 to 15 show how the seam is produced with needles 15 and 17 and loopers 34 and 30. As the needles descend through the pieces L1 and L2 and through the slots 38 and 40, and as said needles first begin to move back up again, the threads F1 and F2 bulge out slightly (FIG. 12) causing them to be caught by the forked end of the lower spreader 34; this spreader 34 pushes threads F1 and F2, as shown, from the position of FIG. 12 through intermediate positions and on to the position of FIG. 13, in which threads F1 and F2 are positioned to form two eyes through which the upper looper 30 then passes; the upper looper 30 pulls thread F3 through these two eyes and disengages them from the spreader 34 as shown in FIG. 14; the upper looper 30 advances with thread F3 until it has positioned it around the raised needles 15 and 17; the needles then descend again as can be seen by comparing FIGS. 13 and 14, and pass between looper 30 and the loop formed by thread F3 so that threads F1 and F2 engage with thread F3 which is intended to form the chain stitches. FIG. 15 shows the retracted position of looper 30 which draws back from the eyes formed by threads F1 and F2 taking with it thread F3 which is now caught around the needles 15 and 17. This process is basically similar to that performed by corresponding components in conventional machines; however, the design of the stitch finger 42 with respect to slots 38 and 40, and the consequent amount of threads F1 and F2 pulled off during the stitch-forming operations, as well as the increased amount of thread F3 pulled off by the thread-pulling arm 25, have the effect that the stitches of the seams shown in FIGS. 2 to 4 are sufficiently long and therefore the seam is flat, i.e. the stitches are loose or slack. Hence in the flattened and coplanar position of the two fabric pieces L1 and L2 sewn together, and in particular with the two fabrics stretched apart (as occurs when putting the garment on), the thickness of the seam is very little greater than the thickness of the fabrics, and there is not that cord-like formation typical of seams produced with the conventional equipment of the overlock machines described above.

Figure 18:
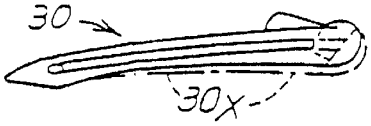
FIGS. 16, 17 and 18 show perspective views of the modified looper and spreader and a view on the plane marked XVIII—XVIII in FIG. 16.
Figure 17:
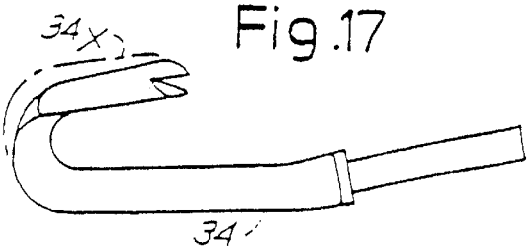
Figure 16:
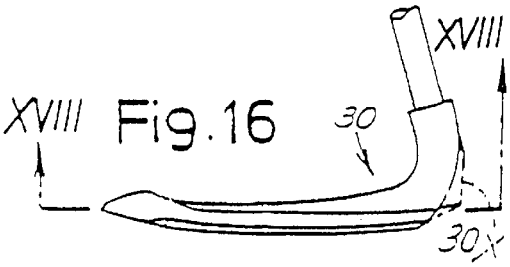

For greater efficiency of the parts of the equipment described, the upper and lower loopers 30 and 34 respectively can be slightly modified compared to the corresponding loopers of the normal equipment of these conventional overlock machines, as shown in particular in FIGS. 16 to 18. In these figures, 30X and 34X indicate the parts that are made smaller, i.e. reduced by removal of material by comparison with the conventional form of these loopers 30 and 34 as shown in chain lines. These measures, in combination with the reduction or shrinking at 42S of the underside of the stitch finger 42 ensure the smooth movement of the two loopers without interfering with the throat plate 36, even when said stitch finger 42 is made larger—as described earlier—than the conventional shape of stitch finger as used in conventional throat plates equivalent to 36. The reduction 42S also helps the feeding of the thread F3 forming the chain stitches.

The particular shape and particular length of the stitch finger 42 mean that the stitches formed with the threads F1, F2 and F3 around the area of the sides 42A and 42B of said stitch finger 42 are longer and are retained for a longer period of time, with the result that they are looser (have less tension). With the same aim of reducing the tension and increasing the slackness of the stitch formed by thread F3, the thread-pulling arm 25, which is the tension device of thread F3 fed to the upper looper 30, is modified in terms of its position on the needle bar 21 as described earlier.

While keeping to the above-indicated essential features of the innovation, it is possible within certain limits to vary the width of the stitch finger 42 in order to obtain, within the sense of a flat seam, a slightly wider or slightly narrower seam, depending on what is felt desirable in any particular case, e.g. depending on the purpose of the seam (on the toes or on the crotch). In correlation with this it is also possible, within certain limits, to vary the distance between the two needles 15 and 17 and, correspondingly, the dimensions of the slots 38, 40.

Thus, as an example, for forming the body section of tights a throat plate 36 can be used that has an even wider stitch finger 42 in order that the stitches made with thread F1 and thread F2 are even longer, in order to produce a seam of greater width. For the closing of the toes of stockings and of the legs of panty-hose, by contrast, a throat plate 36 having a somewhat narrower stitch finger 42 can be used, the effect being to make the two series of stitches formed by threads F1 and F2 somewhat shorter, so that only a limited width of fabric is picked up by the stitches of the seam and so that, as a consequence, the resulting seam is somewhat narrower.

Those skilled in the art wishing to carry out the present innovation will have no difficulty in deciding experimentally, case by case, the ideal width for the stitch finger 42 to produce a seam of the desired width, and to decide, as a consequence of this, what the distance should be between needles 15 and 17, varying the thickness to be interposed between them on the attachment 19 accordingly. It is also possible within certain limits to vary the number of seam stitches per unit length to suit the strength of the knit fabrics.

What is claimed is:

1. Equipment for conventional overlooks comprising a throat plate with needle slots and with a stitch finger on a line of a cut feeders for feeding needle threads and a looper thread;

a twin needle fed with the needle threads;

an upper looper and a lower looper, one of which is fed with a looper thread, the other being a spreader;

a throat plate having two slots for the needles said stitch finger being positioned adjacent one of said two slots said stitch finger having a width for forming seam stitches and comprises, in an area where stitch loops are formed, a portion with approximately parallel sides before a final narrowing and is reduced, i.e. made thinner on underside to make way for movements of the lower looper; and said looper thread pull-off member is arranged to increase an amount of looper thread pulled off by it each time;

looper thread pull-off member which is a thread-pulling arm oscillating with said twin needle, said looper thread pull-off member is positioned on a needle bar of said twin needle at an angle which is further forward in a direction in which the twin needle moves down, in such a way as to increase an active stroke of said pull-off member and thereby increase an amount of the looper thread pulled off at each stroke.

2. Equipment according to claim 1, wherein: said stitch finger is longitudinally elongate.

3. Equipment according to claim 1, wherein: said spreader is reduced, i.e. made thinner at a portion so as not to interfere with the throat plate and with the stitch finger, the upper looper is reduced, i.e. made thinner at a portion to avoid interferences with one of said lower looper, said throat plate and said twin needle.

4. An apparatus for forming an overlock seam between two fabric portions, the apparatus comprising:

a throat plate positionable adjacent the two fabric portions in an overlapped condition, said throat plate defining two needle slots;

a twin needle fed with two needle threads and movable through said two needle slots and the overlapped fabric portions;

a stitch finger arranged adjacent one of said needle slots and positionable on a cut line of the seam;

a first looper arranged as a spreader of the needle threads;

a second looper being fed with a looper thread and for connecting the looper thread with the needle threads;

a looper thread pull-off member for feeding the looper thread to said second looper, said looper thread pull-off member is arranged to cooperate with a size of said stitch plate and said loopers to form a plurality of stitches having length to have the overlook seam lie substantially flat when the two fabric portions are coplanar.

* * * * *